US009925646B1

(12) United States Patent
Codding

(10) Patent No.: US 9,925,646 B1
(45) Date of Patent: Mar. 27, 2018

(54) CUTLERY SHARPENER

(71) Applicant: Donald L. Codding, Eustis, FL (US)

(72) Inventor: Donald L. Codding, Eustis, FL (US)

( * ) Notice: Subject to any disclaimer, the term of this patent is extended or adjusted under 35 U.S.C. 154(b) by 0 days.

(21) Appl. No.: 15/584,329

(22) Filed: May 2, 2017

Related U.S. Application Data

(63) Continuation of application No. 13/432,215, filed on Mar. 28, 2012.

(60) Provisional application No. 61/516,339, filed on Apr. 1, 2011.

(51) Int. Cl.
*B24D 15/02* (2006.01)
*B24D 15/06* (2006.01)
*B24D 15/08* (2006.01)

(52) U.S. Cl.
CPC ..... *B24D 15/02* (2013.01); *B24D 15/06* (2013.01); *B24D 15/084* (2013.01)

(58) Field of Classification Search
CPC ..... B24D 15/02; B24D 15/06; B24D 15/084
USPC ..... 451/523; 76/84; D8/93, 94
See application file for complete search history.

(56) References Cited

U.S. PATENT DOCUMENTS 538,404 A * 4/1895 Benesh ..... B24D 15/081 76/86
825,093 A * 7/1906 Watson ..... B26B 1/044 30/161
963,292 A * 7/1910 Jameson ..... B24D 15/08 76/84
1,312,654 A * 8/1919 Weaver ..... B24D 15/08 76/84
1,442,337 A * 1/1923 Hannaford ..... B24D 15/08 451/62
4,259,815 A * 4/1981 Kuban ..... B24D 15/08 451/552
4,751,795 A * 6/1988 Jenne ..... B24D 15/081 451/461
5,105,586 A * 4/1992 Jenne ..... B24D 15/063 451/540
6,039,642 A * 3/2000 Collins ..... B24D 15/06 451/45
D481,283 S * 10/2003 Watson ..... D8/90
D484,019 S * 12/2003 Waltzer ..... D8/91
D641,227 S * 7/2011 Kuo ..... D8/93
9,039,494 B1 * 5/2015 Dovel ..... B24D 15/08 451/349
2008/0171504 A1 * 7/2008 Smith ..... B24B 3/54 451/540

(Continued)

*Primary Examiner* — Marc Carlson
(74) *Attorney, Agent, or Firm* — Rosenberg, Klein & Lee

(57) ABSTRACT

A cutlery sharpener is disclosed for conditioning a cutlery edge. The cutlery sharpener comprises a sharpening shaft extending between a proximal end and a distal end and defining a sharpening surface for engaging the cutlery edge. A line of symmetry extends through the proximal end and the distal end of the sharpening shaft. A handle extends between a proximal end and a distal end and defining a handle surface for engaging a hand. A non-line of symmetry extends through the proximal end and the distal end of the handle. A couple links the proximal end of the sharpening shaft with the proximal end of the handle. The non-line of symmetry maintains a thumb and a plurality of fingers of the hand in a safe orientation and safe distance from the cutlery edge during displacement of the handle relative to the cutlery edge and engagement between the cutlery edge and the sharpening shaft.

10 Claims, 15 Drawing Sheets

(56) References Cited

U.S. PATENT DOCUMENTS

2014/0127984 A1* 5/2014 Smith ..... B25F 1/00
451/461

* cited by examiner

CUTLERY SHARPENER

CROSS-REFERENCE TO RELATED APPLICATIONS

This Application is being filed as a Continuation of application Ser. No. 13/432,215, filed 28 Mar. 2012; and claims benefit of U.S. Patent Provisional Application Ser. No. 61/516,339, filed Apr. 1, 2011. All subject matter set forth in Provisional Application Ser. No. 61/516,339 is hereby incorporated by reference into the present application as if fully set forth herein.

BACKGROUND OF THE INVENTION

Field of the Invention

This invention relates to sharpening devices and more particularly to a cutlery sharpener.

Background of the Invention

The early development of cutting instruments and devices led almost immediately to the development of cutting instrument sharpening devices. The wide variety of cutting devices has necessitated the development of a wide variety of sharpening devices, materials and systems. The process of sharpening comprises grinding away material on the implement using an abrasive material substantially harder than the material of the implement. These materials include various stones, minerals, synthetic and metallic materials. Some of these materials must be affixed to a support prior to use. These types of sharpeners include grinding wheels, abrasive sticks (including diamond sticks) and the like.

In many instances, a specific type of cutting device will require the use of a sharpener specifically designed for the cutting device. As an example, broadhead arrow tips typically comprise a plurality of small razor sharp blades. The blades are either permanently or removably affixed to the arrow shaft or are designed to mechanically expand on contact. Since these blades are dulled after a few uses, they must be sharpened regularly. Since the blades vary in configuration and shape, the sharpening device must provide the ability to sharpen the broadhead blades and simultaneously prevent the operator from accidental contact with the blades and subsequent injury.

There have been many in the prior art who have attempted to solve these problems with varying degrees of success. None, however completely satisfies the requirements for a complete solution to the aforestated problem. The following U. S. Patents are attempts of the prior art to solve this problem.

U.S. Pat. No. 659,420 to Reichardt discloses new and useful improvements in hand-stones. The invention relates to q toilet article especially adapted for smoothing down rough parts of the skin and removal of stains from the skin. Its main use is to keep the hands in a soft and good condition.

U.S. Pat. No. 707,082 to Brown discloses an improvement in that class of hand instruments employed in the sharpening industry. The invention has an abrasive surface which may readily be removed and replaced by a new one when worn. The surface is securely held in place and rigidly supported throughout its entire area.

U.S. Pat. No. 1,352,888 to Gallagher discloses new and useful improvements in knife sharpeners. The invention relates to improvements in knife sharpeners designed particularly for use by butchers and the like, for sharpening carving and other knives.

U.S. Pat. No. 1,889,630 to Bowden discloses sharpeners primarily designed to restore the cutting edges of safety razor blades without necessitating removal of the blades from the holder.

U.S. Pat. No. 2,112,152 to Froemming discloses improvements in hones or files wherein the exterior surface of the hone is replaceable.

U.S. Pat. No. 2,295,693 to Seigh discloses improvements in abrading implements for dressing down the screw threads of threaded dies and taps. In the use of threaded dies and taps, it frequently occurs that there is a buildup of foreign matter on the threads. Also, when the dies or taps are ground, a burr or fin is sometimes left on the threads. Therefore, it is a principle object of the invention to provide a simply constructed, inexpensive and easily applied abrading implement for dressing down such threads cleanly and quickly to remove burrs, fins, and the like therefrom.

U.S. Pat. No. 2,347,856 to Wachter discloses improvements relating to hones, and with regard to certain specific features, to sharpeners for hand-stroking knives and the like. The invention provides for an economical hand-stroking hone, particularly for culinary and like uses.

U.S. Pat. No. 2,379,569 to Ellis discloses improvements to abrasive tools in any of the many commercial forms such as hones, knife sharpeners, etc. which will have magnetic properties. A further object of the invention is an abrasive instrument or tool in which the core may be of magnetic material and permanently magnetized and the outer shell of the tool of any desired abrasive constituency.

U.S. Pat. No. 2,484,335 to Dingerson discloses a knife sharpener and more particularly to a knife sharpener having an abrasive surface which may be removed. The invention teaches clamping a flexible sheet bearing abrasive material on its outer surface, and support it in a position for use as a knife sharpener.

U.S. Pat. No. 2,519,687 to Miller discloses improvements to abrasive tools and more particularly to holders for abrasive elements especially adapted for cleaning and polishing the commutators of automobile generators and the like.

U.S. Pat. No. 3,819,170 to Longbrake discloses a sharpener to be held in one hand of an operative. The invention comprises clamp members between which an article, arrowhead, knife, etc., having a cutting edge to be sharpened or resharpened, is secured. Pivoted tool guide members extend transversely of the clamp members and each has an aperture therein in which one end of a sharpening instrument or tool, such as, a file, stone, etc., is received while the other end is held by the other hand of the operator and moved over the cutting edge to be sharpened or resharpened.

U.S. Pat. No. 5,109,637 to Calafut discloses an implement having a flexible core to which compressible, resilient and flexible fiber mats bearing fine abrasive material are secured to form a tool that can conveniently conform or coincide with convex, concave, flat or curved surfaces and to corners and crevices to enable improved, easier cleaning and smoothing of relatively soft greenware without damage to the surface. The tool can be an elongated member with parallel working surfaces or it can be a cylindrical, conical or other shape for adaptation to special requirements.

U.S. Pat. No. 5,189,749 to Thomas et al. discloses a multipurpose tool for maintaining hunting arrows. The tool is a sharpener capable of sharpening broadheads. A wrench capable of tightening or loosening broadheads screwed onto an arrow, and a dresser capable of dressing the fletched end of an arrow so that the arrow effectively will receive a nock. The tool has an elongated body with integral longitudinal ridges to enhance its appearance and to facilitate gripping, and is preferably molded of ABS plastic in two pieces. The sharpener and wrench are at the bottom, and the dresser is at the top of the tool. The sharpener comprises a shallow channel running diagonally across the face of the bottom, normal to the axis of the tool, with a plurality of small hard rods imbedded in the sides of the groove. Sharpening is effected by movement of the edge of a broadhead along the shallow groove. The wrench comprises a plurality of deep grooves extending radially from the axis of the tool with the deep grooves arranged so that they will receive the broadhead of an arrow that is coaxial to the tool. The dresser comprises a conical recess formed by a plurality of ribs with a hard blade imbedded in at least one of the ribs. The blade has a flat edge.

U.S. Pat. No. 5,203,123 to Travis discloses a sanding block having a central metallic core which is deformable yet shape retaining. The core is enclosed totally within an elastomeric covering which is non-abrasive.

U.S. Pat. No. 5,273,425 to Hoagland discloses a portable instrument having an angular elongated handle with a free end and a distal end, with abrasive composition mounted on a lateral face of the distal end. The abrasive composition includes microscopic abrasive mineral embodied in phenolic resin encasing nylon fibrous strands mounted on a resilient synthetic sponge secured to the lateral face. The elongated handle closer to the distal end has an enlargement as a finger support. The distal end narrows to a thin thickness adapted to fit into narrow gaps adjacent a pet's teeth.

U.S. Pat. No. 6,048,262 to Ray discloses a honing device for culinary knives having a handle assembly formed of a knob portion mounted on the top end of a vertically oriented handle portion. An inverted frusto-conical knife guide is connected to the bottom end of the handle portion. The elongated hone is preferably tubular and it is connected to the bottom end of the knife guide. A coupling inserted into the bottom end of the tubular hone has a rubber friction tip mounted on its bottom end. An elongated draw bar rod has external threads on its top and bottom end. The top end of the draw bar rod passes through aligned bores in the knife guide and the handle portion and is received in a threaded bore in the bottom of the knob portion. The bottom end of the draw bar rod is received in the threaded bore in the top end of the coupling that has a rubber tip in its respective bottom end. The honing device is light weight and easily assembled and disassembled.

U.S. Pat. No. 6,251,003 to LeVine discloses a hand-held sharpening device for sharpening a blade including an elongated sharpening polygon having a plurality of substantially planar sharpening surfaces for receiving the edge of a blade, opposite ends on the elongated sharpening polygon. A plastic cap covers each of the ends, a graspable extension extends outwardly from one of the caps, and a tie in the form of a chain is secured to the graspable extension.

U.S. Pat. No. 6,547,656 to LeVine discloses a sharpener for a serrated knife having a plurality of ribbed cutting edges interspersed with concave cutting edges. The sharpener consists of an elongated abrasive sharpening member having a longitudinal axis and a peripheral surface. A ribbed configuration on the peripheral surface extends longitudinally of the longitudinal axis for slidably engaging the ribbed cutting edges, and a convex surface on the peripheral surface extending longitudinally of the longitudinal axis for slidably engaging the concave cutting edges.

U.S. Pat. No. 6,676,490 to Kendhammer discloses a blade sharpening and edge uncurling device for sharpening dull blades. The device includes a handle at one end and a conical steel for uncurling edges at an opposite end. A threaded stone retaining shaft bridging between the handle and the steel maintains a circumscribing sleeved stone section in position for sharpening the blades. When the sleeved stone section needs to be replaced, the threaded stone retaining shaft is simply unthreaded to expose the stone for removal and replacement.

U.S. Pat. No. 7,553,220 to Smith discloses a hand held retractable abrasive sharpener having a rod formed with a tapered end portion and a partially cylindrical opposite end portion. A part of the partially cylindrical opposition end portion is flat. A slot is formed in the rod. Substantially all of the outer surfaces include layers of the rod have an abrasive material. The rod is carried in a carrying case for transport and storage in a locked relationship and being capable of being released and withdrawn for sharpening with carrying case serving as a holder.

U.S. Design Pat. D402,523 to Thomas discloses an ornamental design for a knife sharpener.

U.S. Design Pat. D421,706 to Lion et al. discloses an ornamental design for a knife sharpener.

U.S. Design Pat. D515,900 to Sours et al. discloses an ornamental design for a blade sharpener with handle.

Although the aforementioned prior art have contributed to the development of the art of sharpening a cutting device, none of these prior art patents have solved the needs of this art.

Therefore, it is an object of the present invention to provide an improved apparatus for sharpening of cutting implements.

Another object of this invention is to provide an improved apparatus for the sharpening of broadhead arrow tips.

Another object of this invention is to provide an improved apparatus that is simple and safe for the operator to use.

Another object of this invention is to provide an improved apparatus that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a cutlery sharpener for conditioning a cutlery edge. The cutlery edge extends between a first edge end and a second edge end. The cutlery sharpener is grasped by a hand of a user. The hand has a thumb and a plurality of fingers. The cutlery sharpener comprises a sharpening shaft extending between a proximal end and a distal end and defining a sharpening surface for engaging the cutlery edge. A line of symmetry extends through the proximal end and the distal end of the sharpening shaft. A handle extends between a proximal end and a distal end and defining a handle surface for engaging the hand. A non-line of symmetry extends through the proximal end and the distal end of the handle. A couple links the proximal end of the sharpening shaft with the proximal end of the handle. The non-line of symmetry maintains the thumb and the plurality of fingers of the hand in a safe orientation and safe distance from the cutlery edge during displacement of the handle relative to the cutlery edge and engagement between the cutlery edge and the sharpening shaft.

In a more specific embodiment of the invention, a linear handle displacement of the handle relative to the cutlery edge causes a linear sharpener displacement of the sharpening shaft relative to the cutlery edge. A rotation handle displacement of the handle relative to the cutlery edge causes a rotation sharpener displacement of the sharpening shaft relative to the cutlery edge. The linear sharpener displacement and the rotation sharpener displacement define a compound sharpener displacement of the sharpening shaft relative to the cutlery edge for reducing the linear handle displacement required for the sharpening shaft to traverse against the cutlery edge. The non-line of symmetry facilitates the compound sharpener displacement for maintaining the thumb and the plurality of fingers of the hand in a safe orientation and safe distance from the cutlery edge and preventing contact between the hand of the user and the cutlery edge.

In a more specific embodiment of the invention, the sharpening shaft includes a circular cross-section. The distal end of the sharpening shaft includes a first diameter. The proximal end of the sharpening shaft includes a second diameter. The second diameter has a greater diameter than the first diameter for a defining a conical body in the sharpening shaft.

In another more specific embodiment of the invention, the handle includes a circular cross-section. The proximal end of the handle includes a third diameter. The distal end of the handle includes a fourth diameter. The fourth diameter has a greater diameter than the third diameter for a defining a conical body in the handle.

In one embodiment of the invention, the handle includes an arcuate arm.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
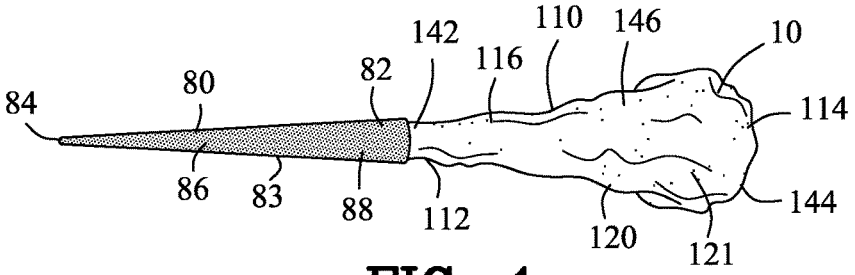
FIG. 1 is a top view of a cutlery sharpener for conditioning a cutlery edge of the present invention.
Figure 2:
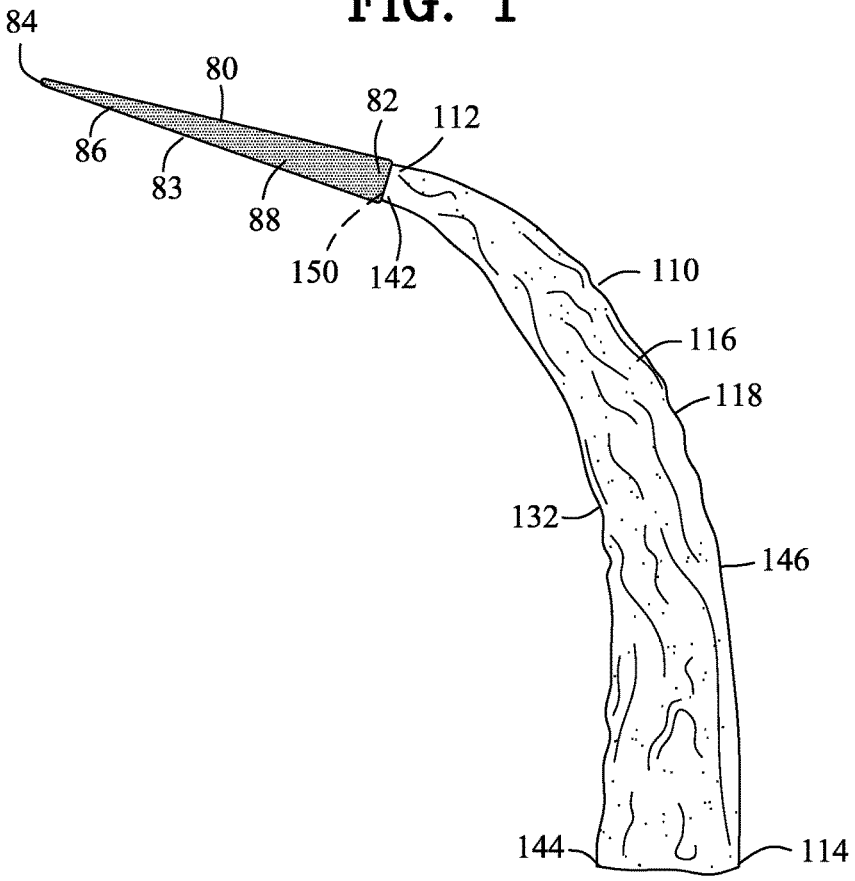
FIG. 2 is a right side view of FIG. 1.
Figure 3:
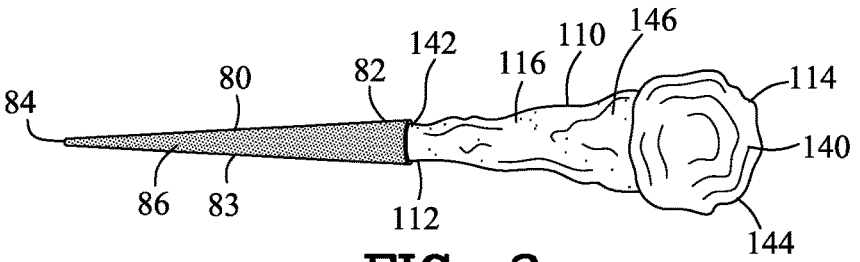
FIG. 3 is a bottom view of FIG. 1.
Figure 4:
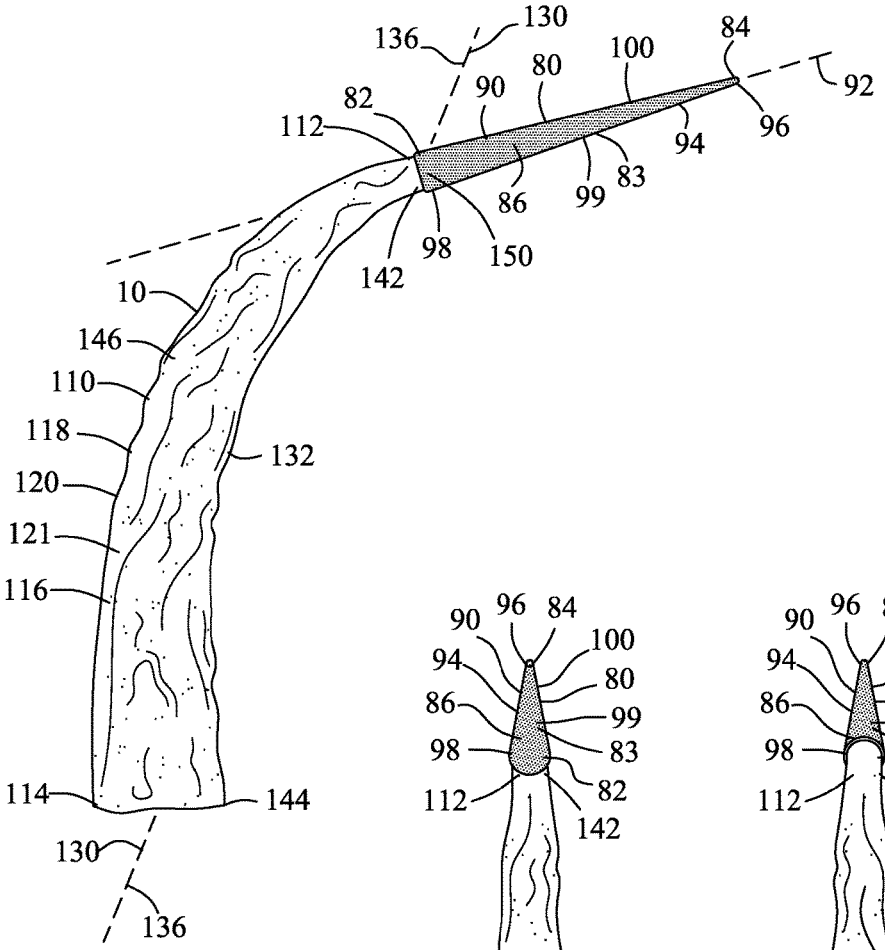
FIG. 4 is a left side view of FIG. 1.
Figure 5:
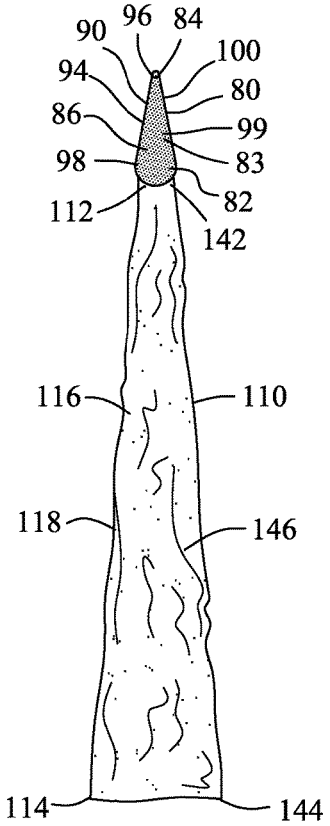
FIG. 5 is a front view of FIG. 1.
Figure 6:
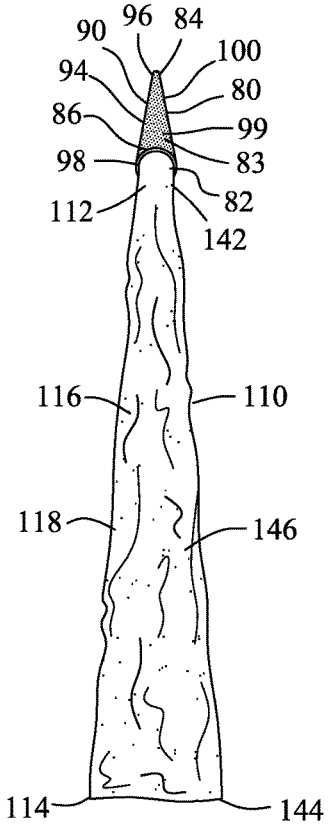
FIG. 6 is a rear view of FIG. 1.
Figure 7:
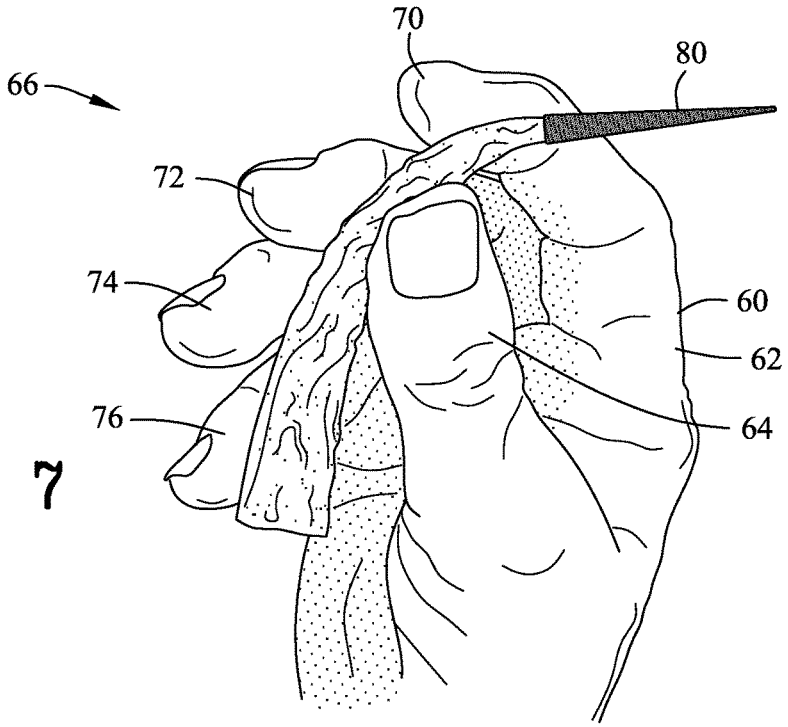
FIG. 7 is a view similar to FIG. 4 illustrating a hand grasping a handle of the cutlery sharpener.

FIGS. 1-44 are various views of a cutlery sharpener 10 for conditioning or sharpening a cutlery edge 20. As shown in FIGS. 8-10 and 24-29, the cutlery edge 20 extends between a first edge end 22 and a second edge end 24. The cutlery edge 20 may include but not limited to a blade 30 of a knife; scissors, fish hook, or as shown in FIGS. 8-10 and 24-29 a blade 30 of an arrowhead 32.

Figure 8:
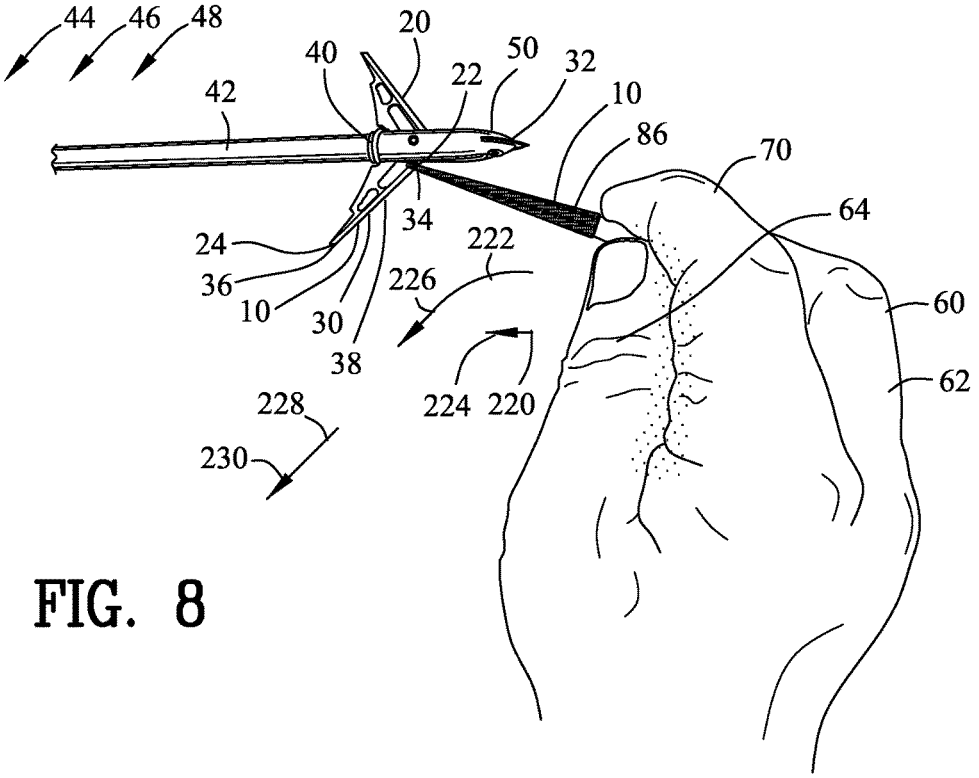
FIG. 8 is a view similar to FIG. 7 illustrating a distal end of a sharpening shaft having a first diameter engaging and sharpening an interior end of a blade on a mechanical arrowhead by both a linear handle displacement and a rotation handle displacement for creating a compound sharpener displacement of the sharpening shaft relative to the blade.
Figure 9:
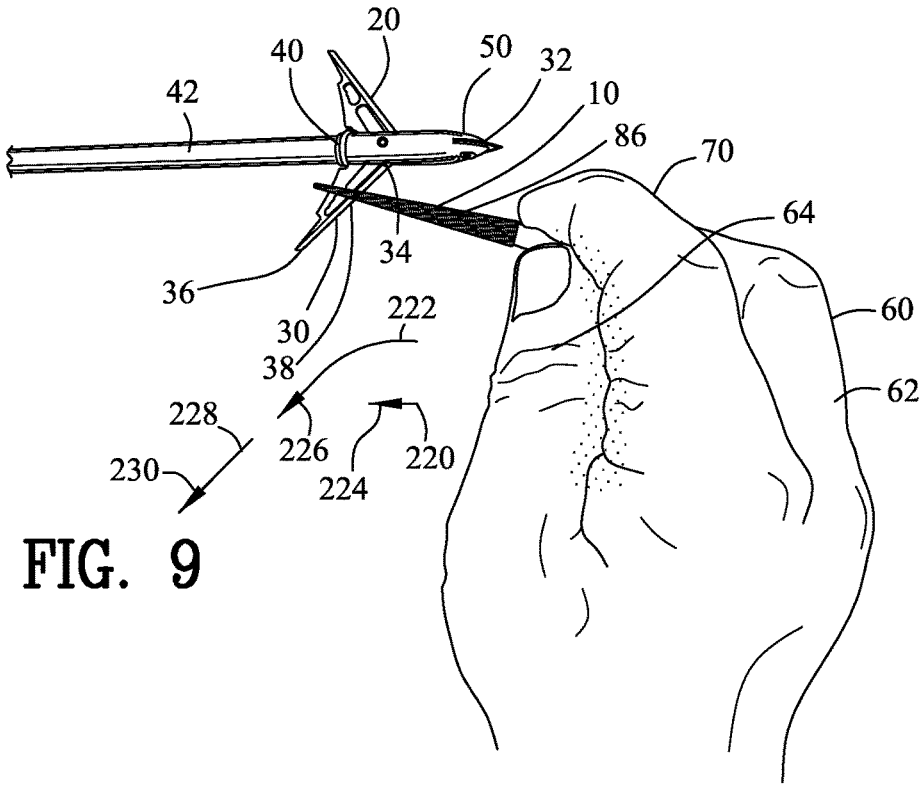
FIG. 9 is a view similar to FIG. 8 illustrating an intermediate portion of the sharpening shaft having a fifth diameter engaging and sharpening a midway portion of the blade by both the linear handle displacement and the rotation handle displacement for creating the compound sharpener displacement of the sharpening shaft relative to the blade.
Figure 10:
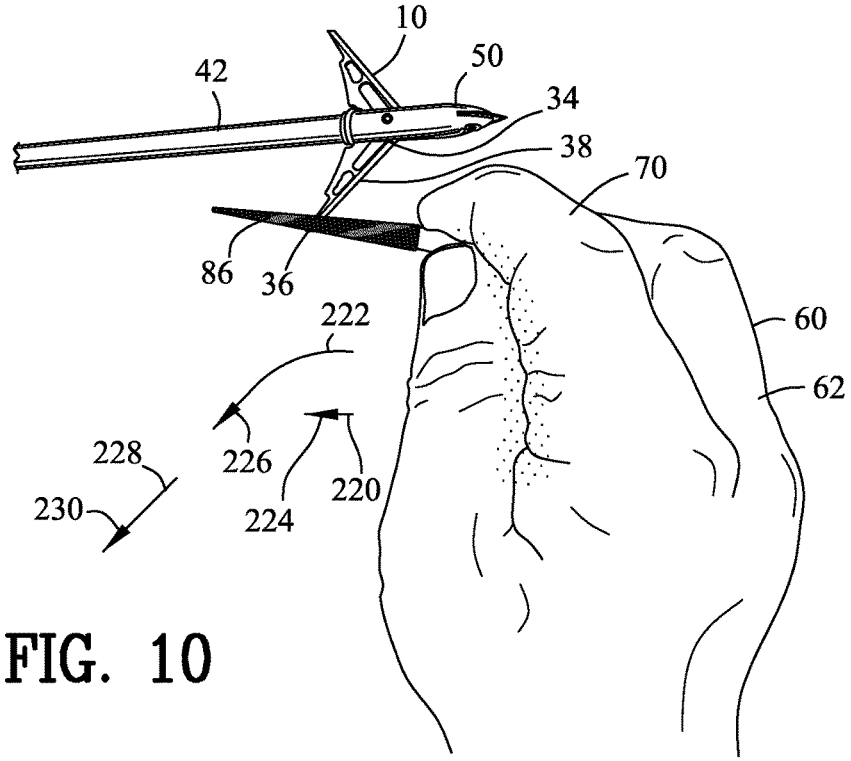
FIG. 10 is a view similar to FIG. 9 illustrating a proximal end of the sharpening shaft having a second diameter engaging and sharpening an exterior end of the blade by both the linear handle displacement and the rotation handle displacement for creating the compound sharpener displacement of the sharpening shaft relative to the blade.
Figure 11:
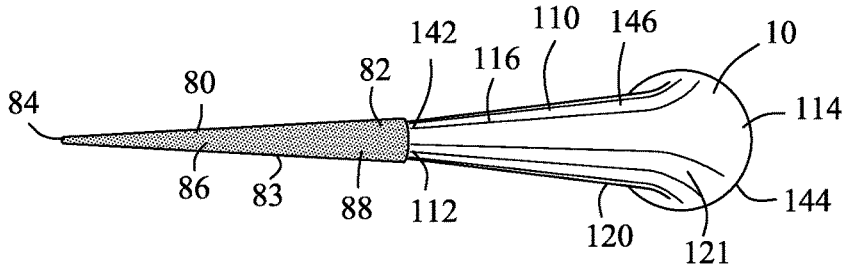
FIG. 11 is a view similar to FIG. 1 illustrating a second embodiment of the present invention.
Figure 12:
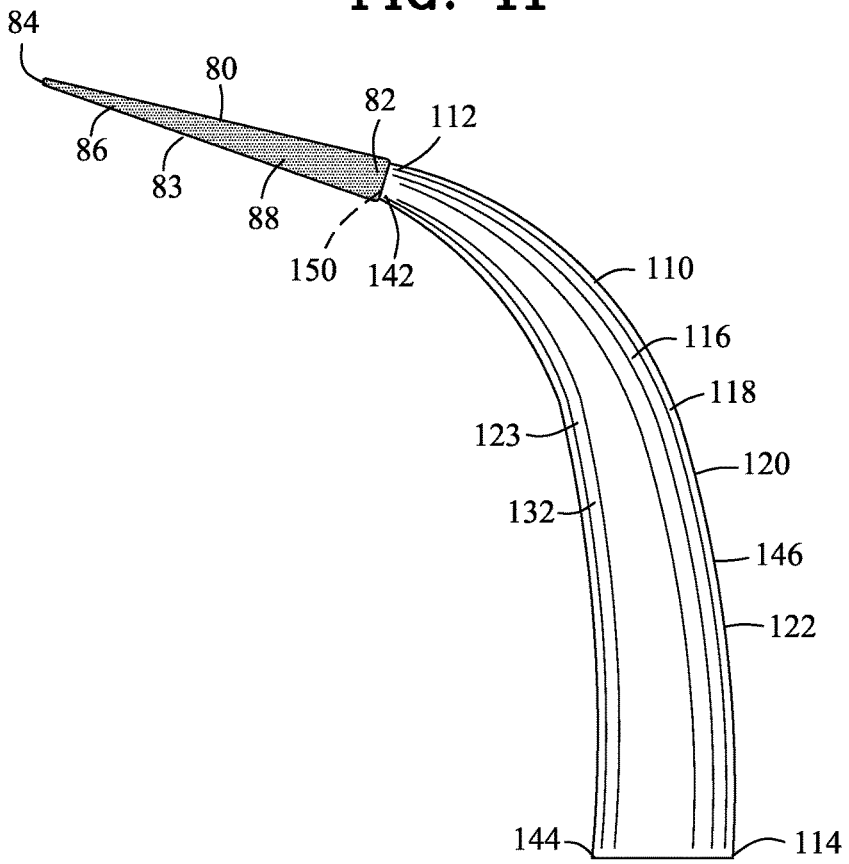
FIG. 12 is a right side view of FIG. 11.
Figure 13:
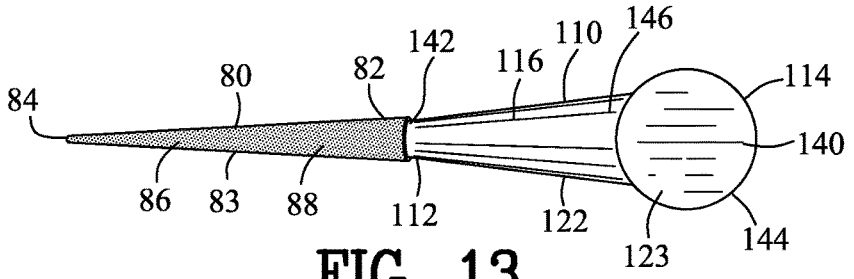
FIG. 13 is a bottom view of FIG. 11.
Figure 14:
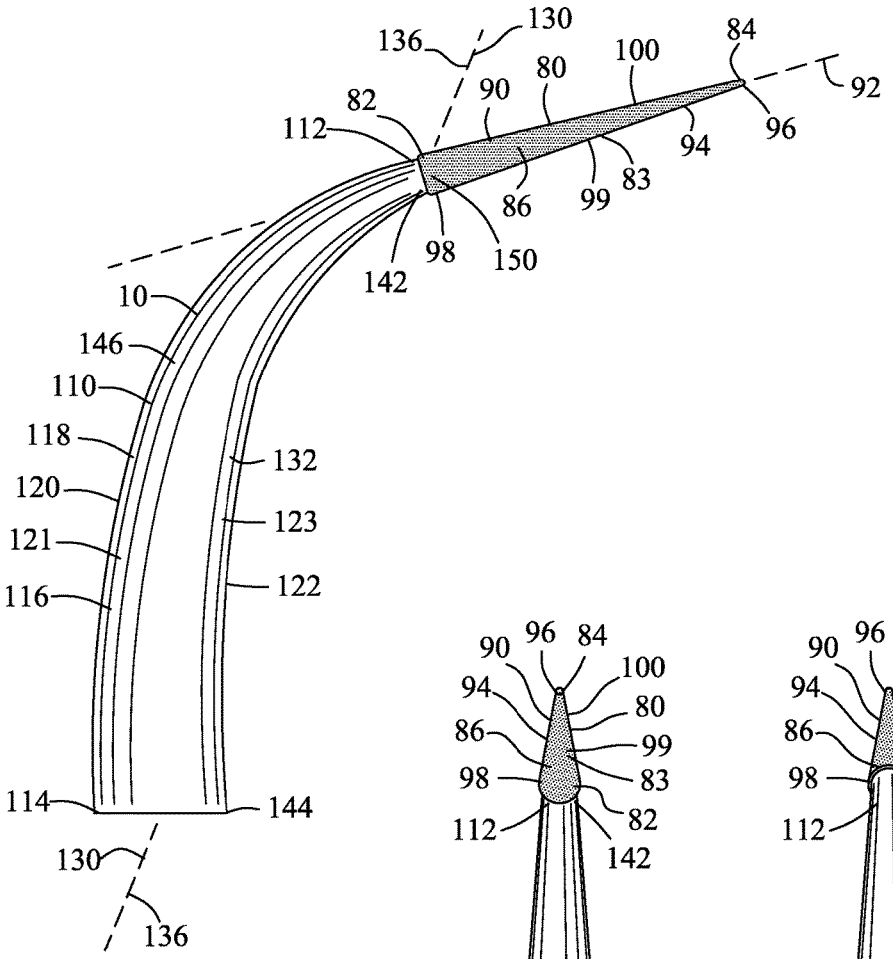
FIG. 14 is a left side view of FIG. 11.
Figure 15:
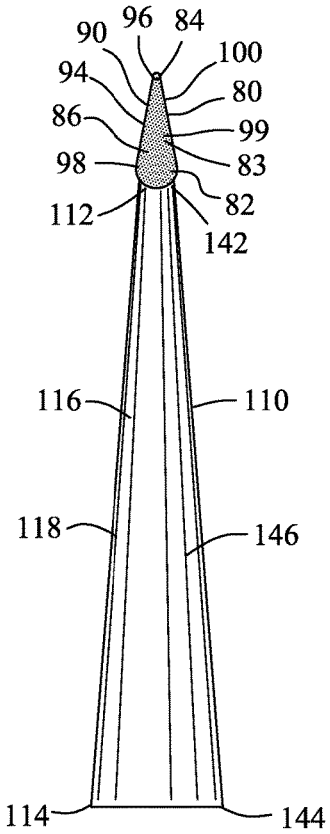
FIG. 15 is a front view of FIG. 11.
Figure 16:
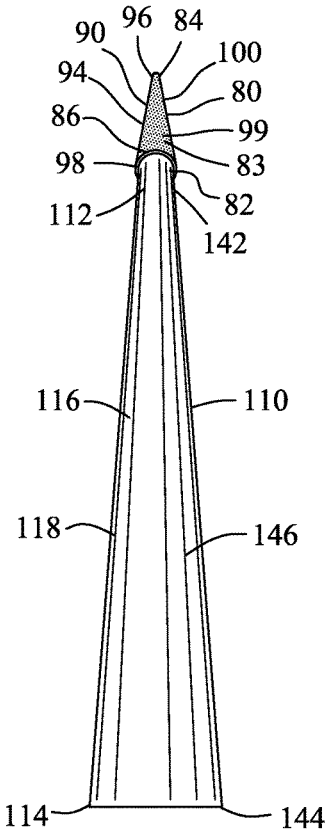
FIG. 16 is a rear view of FIG. 11.
Figure 17:
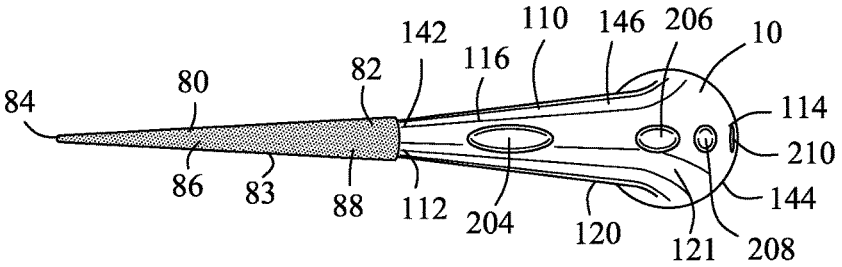
FIG. 17 is a view similar to FIG. 11 illustrating a third embodiment of the present invention.
Figure 18:
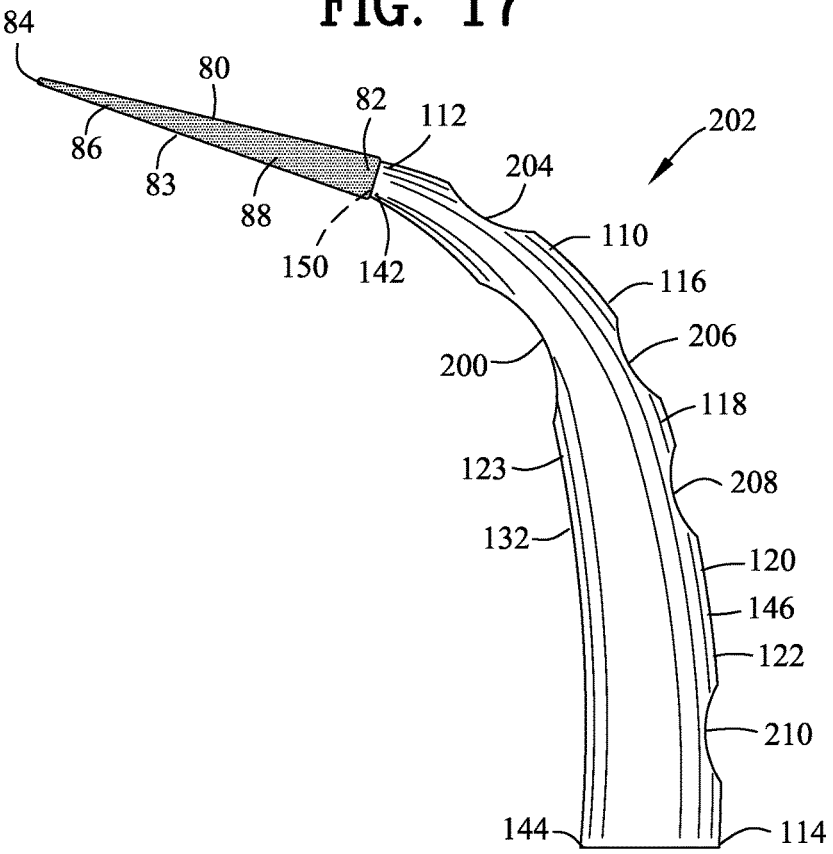
FIG. 18 is a right side view of FIG. 17.
Figure 19:
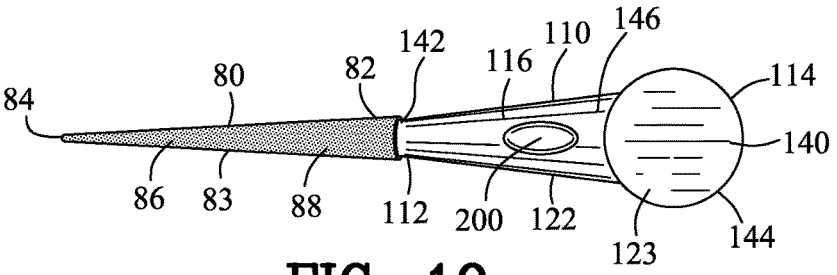
FIG. 19 is a bottom view of FIG. 17.
Figure 27:
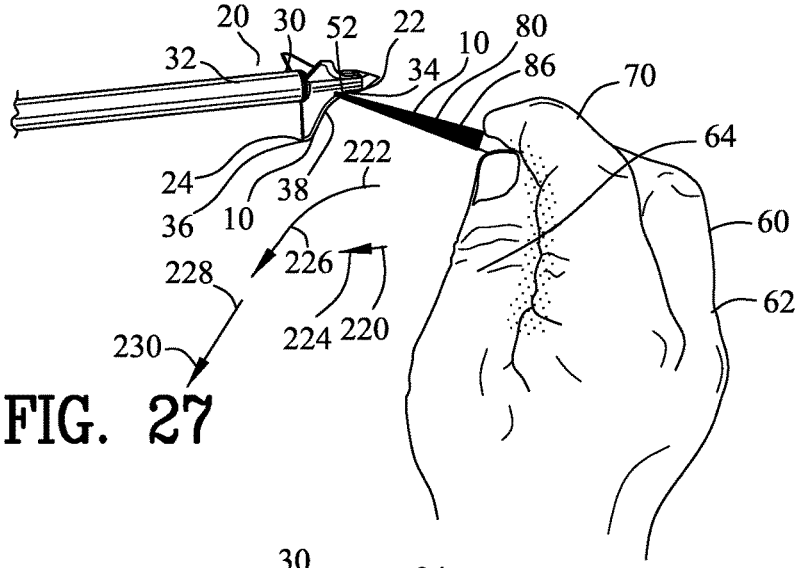
FIG. 27 is a view similar to FIG. 8 illustrating the distal end of the sharpening shaft having the first diameter engaging and sharpening an interior end of a blade on a second non mechanical fitted broadhead arrowhead by both a linear handle displacement and a rotation handle displacement for creating a compound sharpener displacement of the sharpening shaft relative to the blade.
Figure 28:
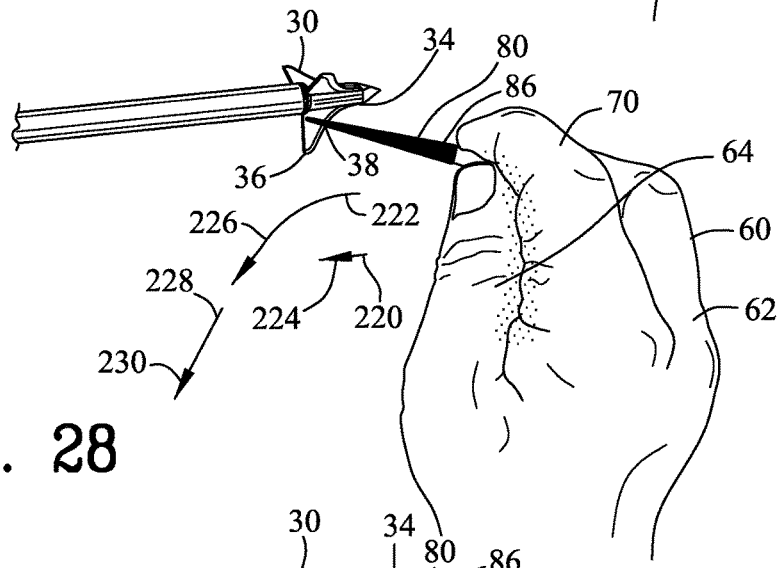
FIG. 28 is a view similar to FIG. 27 illustrating the intermediate portion of the sharpening shaft having the fifth diameter engaging and sharpening a midway portion of the blade by both the linear handle displacement and the rotation handle displacement for creating the compound sharpener displacement of the sharpening shaft relative to the blade.
Figure 29:
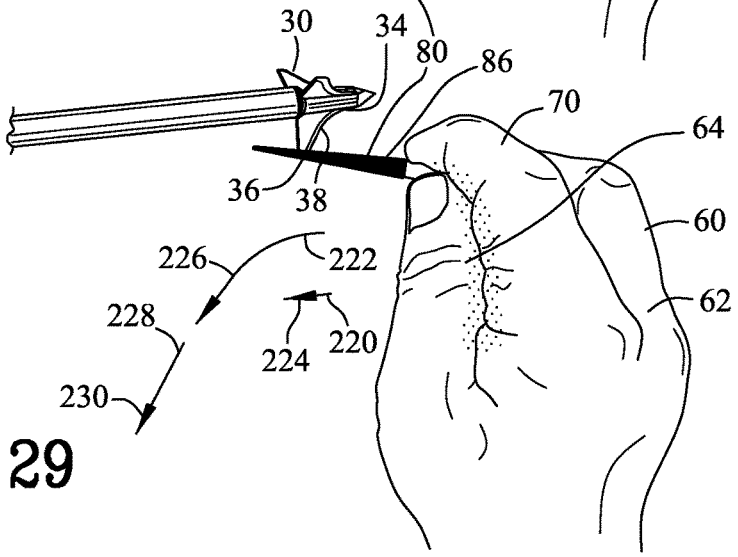
FIG. 29 is a view similar to FIG. 28 illustrating the proximal end of the sharpening shaft having the second diameter engaging and sharpening the exterior end of the blade by both the linear handle displacement and the rotation handle displacement for creating the compound sharpener displacement of the sharpening shaft relative to the blade.
Figure 30:
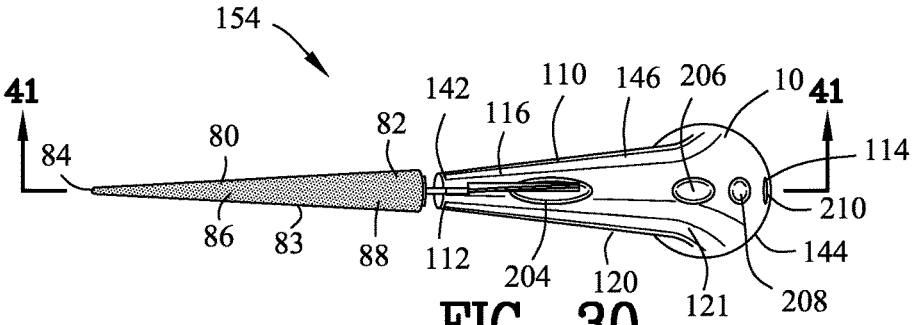
FIG. 30 is a view similar to FIG. 17 illustrating a fourth embodiment of the present invention wherein the pivot point mechanism is positioning the sharpening shaft in a utility position.

The blade 30 of the arrowhead extends between an interior end 34 and an exterior end 36. A midway portion 38 is defined between the interior end 34 and an exterior end 36 of the blade 30. The arrowhead 32 is secured to a front end 40 of a shaft 42. A rear end 44 of the shaft 42 includes a fletching 46 and a nock 48. The cutlery sharpener 10 may be utilized with infinite types of arrowheads 32. FIGS. 8-10, illustrate the cutlery sharpener 10 being utilized with a mechanical arrowhead 50. FIGS. 24-27 illustrate the cutlery sharpener 10 being utilized with a first non mechanical fitted broadhead arrowhead 52. FIGS. 27-29 illustrate the cutlery sharpener 10 being utilized with a second non mechanical fitted broadhead arrowhead 54.

The cutlery sharpener 10 may be rigidly secured by utilizing a vice or other anchoring means. However, preferably, the cutlery sharpener 10 may be grasped by a hand 60 of a user 62. The hand 60 has a thumb 64 and a plurality of fingers 66 including an index finger 70, middle finger 72, ring finger 74 and little finger 76.

As shown in FIGS. 1-44, the cutlery sharpener 10 comprises a sharpening shaft 80 extending between a proximal end 82 and a distal end 84 and defining a sharpening surface 86 for engaging the cutlery edge 20. The sharpening shaft 80 further defines a sharpening shaft length 88. The sharpening shaft 80 may be constructed from various substances including but not limited to diamonds, synthetic or natural stones or stout leather or canvas. FIGS. 1-44, illustrate the sharpening shaft 80 including a diamond stick 90. The diamond stick 90 may include a course, medium or fine abrasive surface for varying the volume of material to be ground from the cutlery sharpener 10.

As best shown in FIGS. 4, 14, 20 and 33, the sharpening shaft 80 has a line of symmetry 92 extending through the proximal end 82 and the distal end 84 of the sharpening shaft 80. The sharpening shaft 80 further includes an intermediate portion 83 interposed between the proximal end 82 and the distal end 84. The sharpening shaft 80 may include a circular cross-section 94 wherein the distal end 84 of the sharpening shaft 80 includes a first diameter 96 and the proximal end 82 of the sharpening shaft 80 includes a second diameter 98. The second diameter 98 has a greater diameter than the first diameter 96 for a defining a conical body 100 in the sharpening shaft 80. The sharpening shaft 80 further includes a fifth diameter 99 interposed between the proximal and 82 and distal end 84 of the sharpening shaft 80. The fifth diameter 99 includes a diameter wherein the fifth diameter 99 is less then the second diameter 98 but greater than the first diameter 96.

As best shown in FIGS. 4, 14, 20 and 33, the cutlery sharpener 10 further comprises a handle 110 extending between a proximal end 112 and a distal end 114 and defines a handle surface 116 for engaging the hand 60. The handle 110 further defines a handle length 118. The handle 110 may be constructed from various substances, including but not limited to a deer antler 120 as shown in FIGS. 1-7, a polymeric material 122 as shown in FIGS. 11-44, metallic material, ceramic or other rigid materials.

As best shown in FIGS. 4, 14, 20 and 33, the handle 110 has a non-line of symmetry 130 extending through the proximal end 112 and the distal end 114 of the handle 110. More specifically, the handle 110 may define an arcuate arm 132 extending between the proximal end 112 and the distal end 114 of the handle 110. The handle length of 118 may be portioned relative to the sharpening shaft length 88 such that the handle length 118 is 1½ times the length of the sharpening shaft length 88. The handle may include a circular cross-section 140 wherein the proximal end 112 of the handle 110 includes a third diameter 142 and the distal end 114 of the handle 110 includes a fourth diameter 144. The fourth diameter 144 has a greater diameter than the third diameter 142 for a defining a conical body 146 in the handle 110.

As shown in FIGS. 1-29, the sharpening shaft 80 is linked to the handle 110 by a couple 150. The couple 150 links the proximal end 82 of the sharpening shaft 80 with the proximal end 112 of the handle 110. The couple 150 may include a metallic biscuit wherein the couple 150 is secured to the sharpening shaft 80 and the handle 110 by a mechanical, adhesive and/or compressive coupling.

The coupling as shown in FIGS. 30-44, may also include a pivot point mechanism 152. The pivot point mechanism 152 pivotably couples the sharpening shaft 80 between a utility position 154 as shown in FIGS. 30-35 and 41 and a stowed position 156 as shown in FIGS. 36-38 and 43. As shown in FIGS. 36-44, the pivot point mechanism 152 extends between a pivot plate 160 and a mounting cylinder 162. The pivot plate 160 is inserted into a pivot cavity 124 located in the proximal end 112 of the handle 110. A pivot plate aperture 164 traverses the pivot plate 160. A first handle aperture 126 and a second handle aperture 128 traverse the proximal end 112 of the handle 110. A pivot pin 166 engages through the first handle aperture 126, the pivot plate aperture 164 and the second handle aperture 128 for pivotally securing the pivot point mechanism 152 relative to the handle 110. The mounting cylinder 162 is inserted into the proximal end 82 of the sharpening shaft 80 by a mechanical, adhesive and/or a compressive coupling.

As shown in FIGS. 30-44, a liner leaf spring lock 170 may be inserted into a lock cavity 134 located in the handle 110. The liner leaf spring lock 170 extends between a static end 172 and a dynamic end 174. The static end 172 is coupled within the lock cavity 134. The liner leaf spring lock 170 is permitted to bend laterally within the lock cavity 134 for displacing the dynamic end 174. The dynamic end 174 of the liner leaf spring lock 170 may engage and disengage with a locking notch 168. The locking notch 168 is integral with the pivot plate 160.

Figure 31:
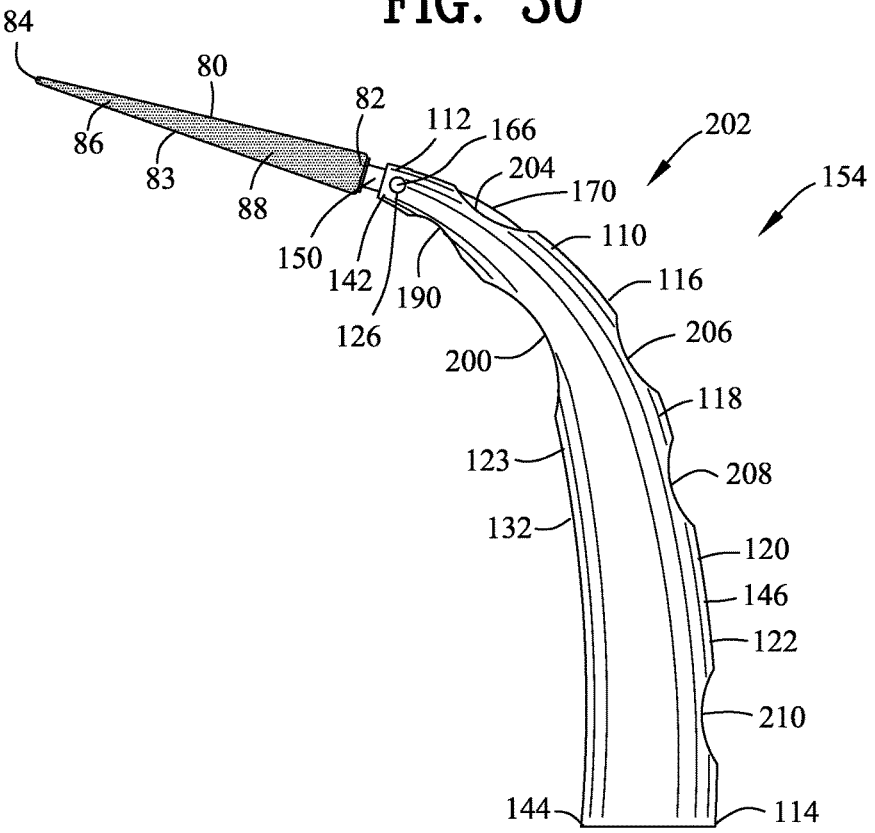
FIG. 31 is a right side view of FIG. 30.
Figure 32:
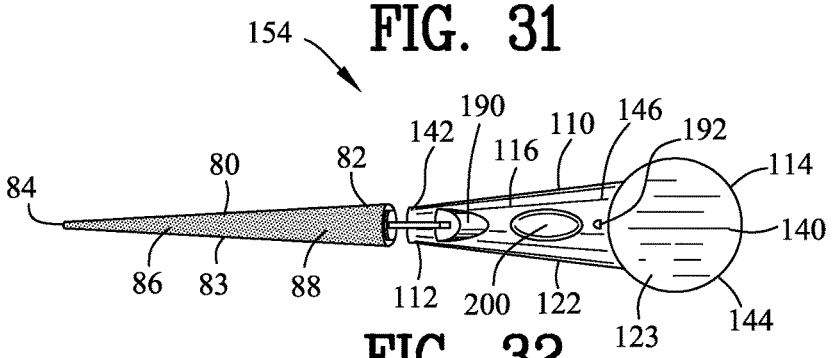
FIG. 32 is a bottom view of FIG. 30.
Figure 33:
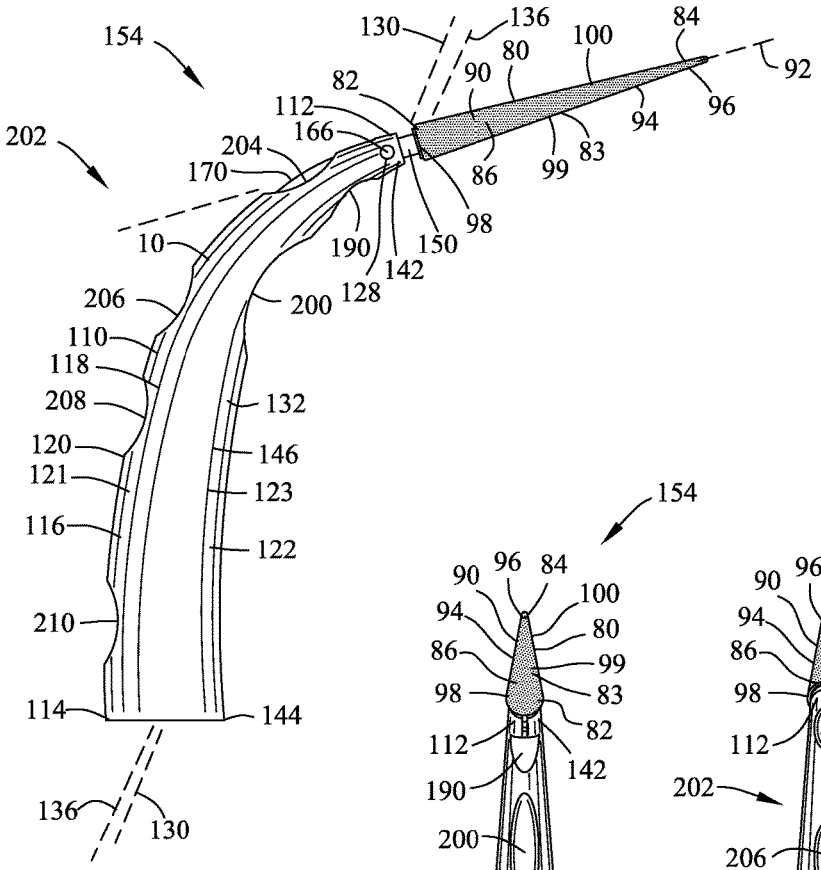
FIG. 33 is a left side view of FIG. 30.
Figure 34:
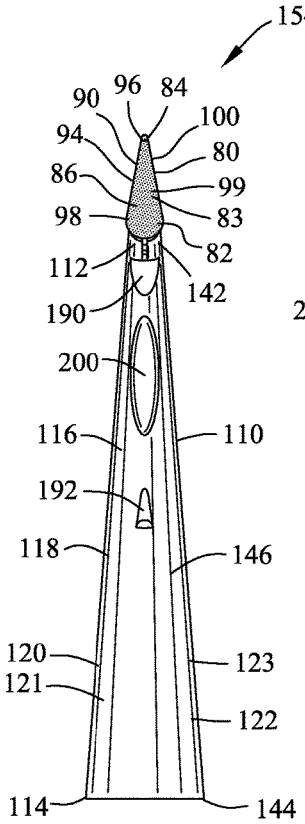
FIG. 34 is a front view of FIG. 30.
Figure 35:
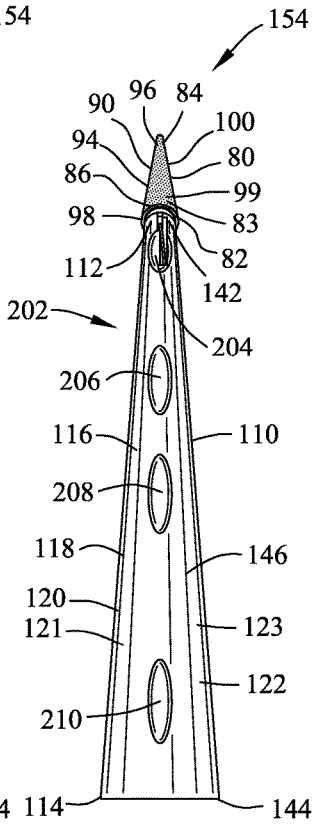
FIG. 35 is a rear view of FIG. 30.
Figure 36:
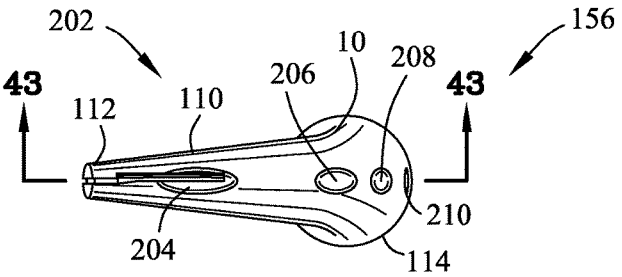
FIG. 36 is a view similar to FIG. 30 illustrating the pivot point mechanism positioning the sharpening shaft in a stowed position.
Figure 37:
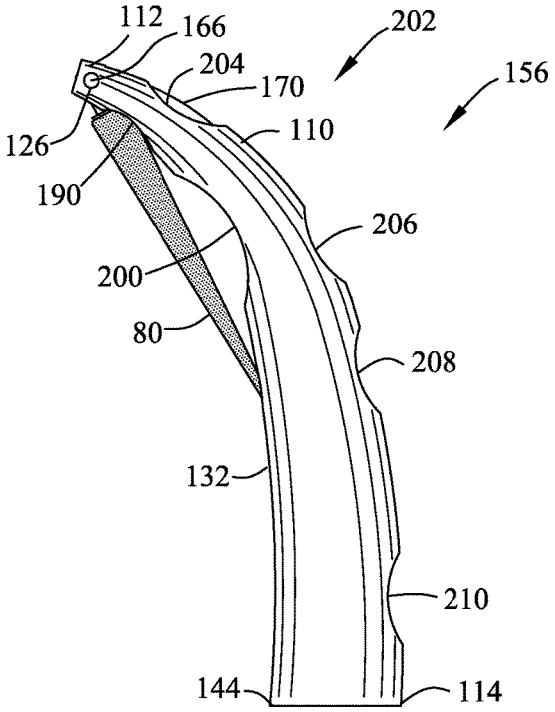
FIG. 37 is a right side view of FIG. 36.
Figure 38:
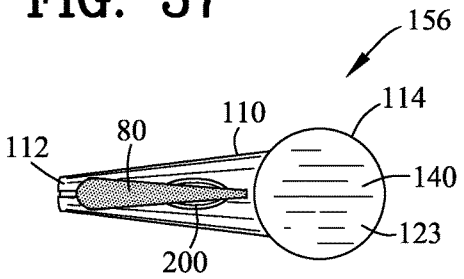
FIG. 38 is a bottom view of FIG. 36.
Figure 39:
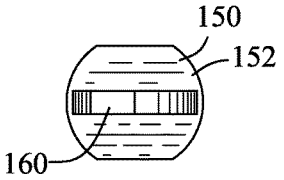
FIG. 39 is a top view of the pivot point mechanism of FIG. 36.
Figure 40:
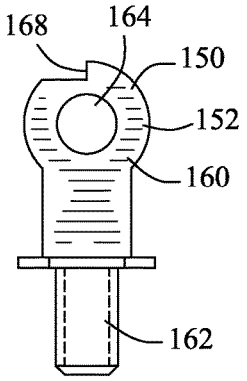
FIG. 40 is a side view of FIG. 39.
Figure 41:
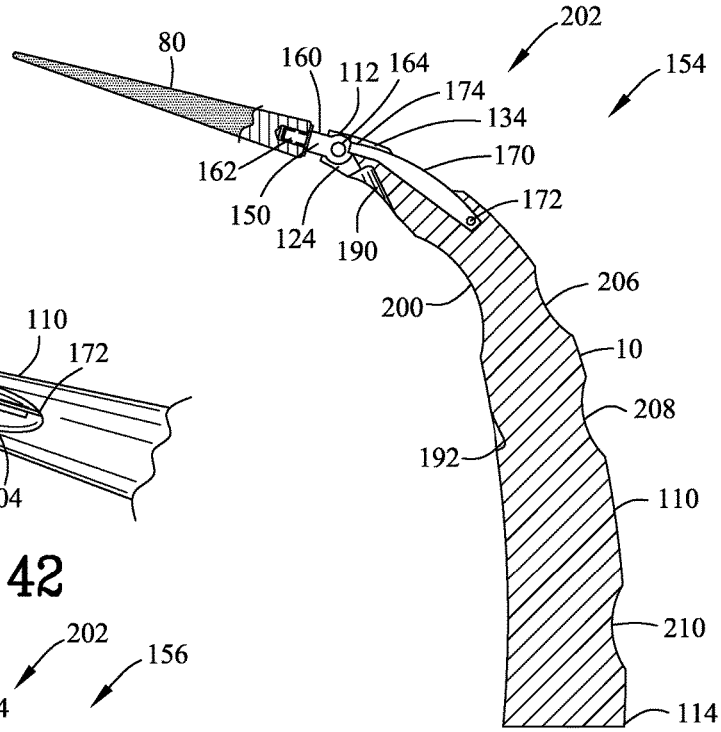
FIG. 41 is a sectional view along line 41-41 in FIG. 30.
Figure 42:
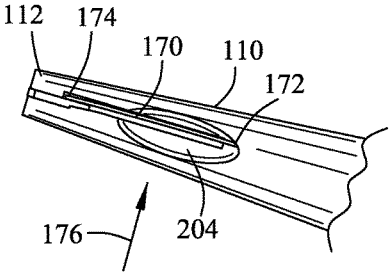
FIG. 42 is a portion of FIG. 36 illustrating a pushing force applied to a liner lock leaf spring for displacing the liner lock leaf spring from the pivot point mechanism and permitting the sharpening shaft to pivot from the utility position to the stow position.
Figure 43:
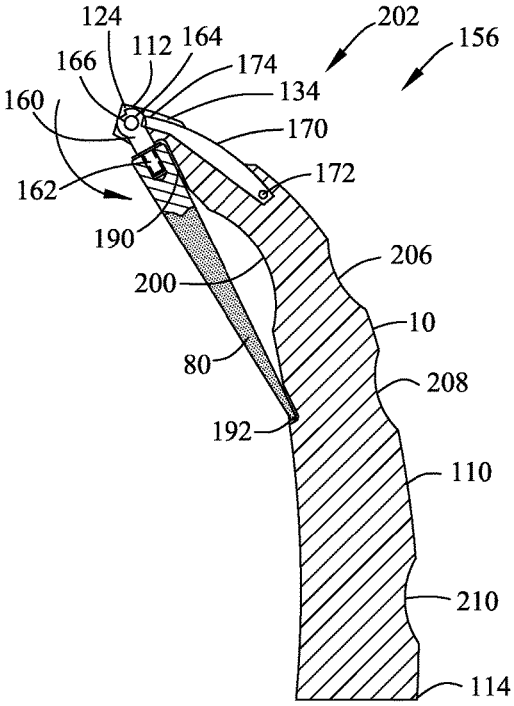
FIG. 43 is a sectional view along line 43-43 in FIG. 36.

As best shown in FIGS. 31, 33 and 41, the locking notch 168 receives the dynamic end 174 of the liner leaf spring lock 170 upon the sharpening shaft 80 position in to the utility position 154. The engagement between the locking notch 168 and the liner leaf spring lock 170 retains the sharpening shaft 80 in the utility position 154 and prevents inadvertent pivoting of the sharpening shaft 80 relative to the handle 110. As shown in FIGS. 42 and 43, in order to transition the sharpening shaft 80 from the utility position 154 to the stowed position 156, a linear force 176 is applied upon the liner leaf spring lock 170 for displacing the dynamic end 174 of the liner league spring lock 170 relative to the locking notch 168. Thereafter, the pivot plate 160 is permitted to rotate upon the pivot pin 166.

Figure 44:
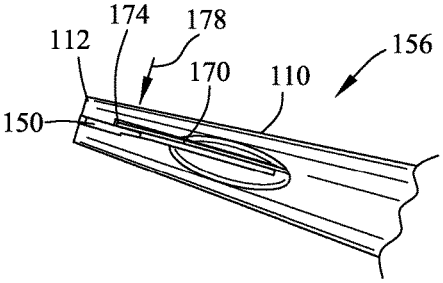
FIG. 44 is a view similar to FIG. 42 illustrating the liner lock leaf spring applying a retention force against the pivot point mechanism for retaining the sharpening shaft in the stow position.

As shown in FIG. 44, upon the release of the linear force 176, the liner least spring lock 170 applies a compressive force 178 against the pivot plate 160 for resisting the pivoting of the pivot plate 160 relative to the liner leaf spring lock 170. This compressive force 178 assists in maintaining the sharpening shaft 80 in the stowed position 156.

The handle 110 may further include a first inner cavity 190 and a second inner cavity 192 for receiving sharpening shaft 80 in the stowed position 156. The first inner cavity 190 is positioned adjacent to the proximal end 112 of the handle 110 for receiving a portion of the proximal end 82 of the sharpening shaft 80 within the handle 110 in the stowed position 156. The second inner cavity 192 is positioned adjacent to the distal end 114 of the handle 110 for receiving the distal end 84 of the sharpening shaft 80 within the handle 110 in the stowed position 156.

As mentioned above, the handle 110 may comprise a deer antler 120. The deer antler 120 may be preferable to the user 62 in that the deer antler 120 includes a plurality of raised surfaces 121 for improving grasping of the handle 110 by the hand 60 of the user 62. Furthermore, the deer antler 120 may provide a novelty characteristic and a natural feel from the handle 110. Alternatively, as also mentioned above, the handle 110 may comprise a polymeric material 122. The polymeric material 122 may incorporate a textured surface 123 integral to the handle surface 116 of the handle 110 for an improved grasping of the handle 110 by the hand 60.

Figure 20:
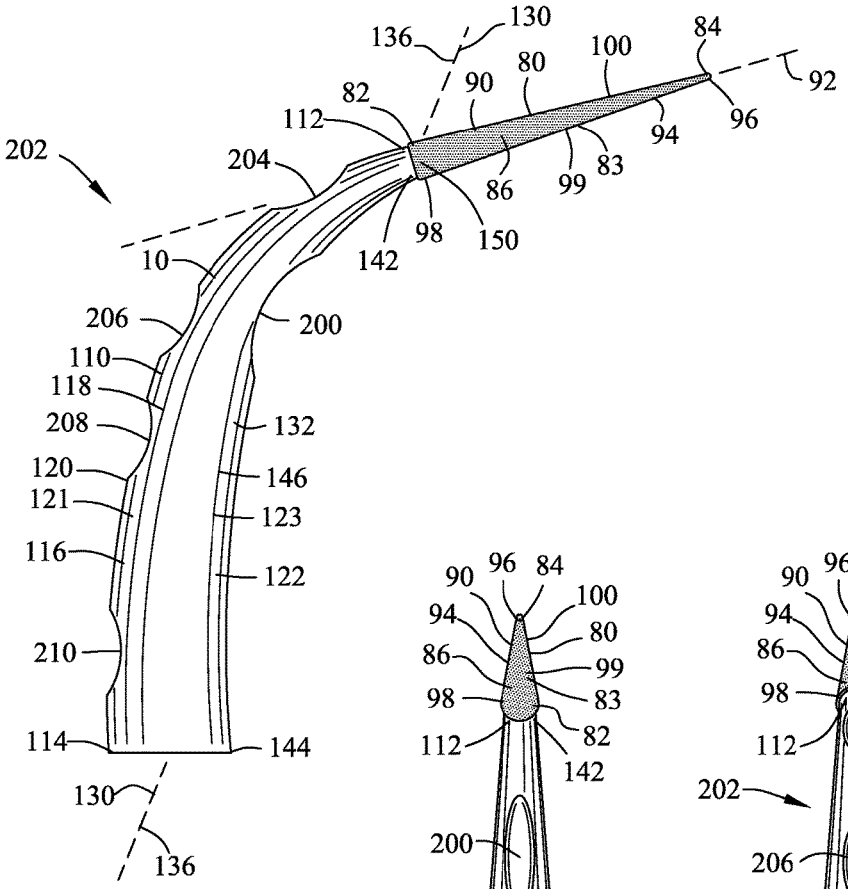
FIG. 20 is a left side view of FIG. 17.
Figure 21:
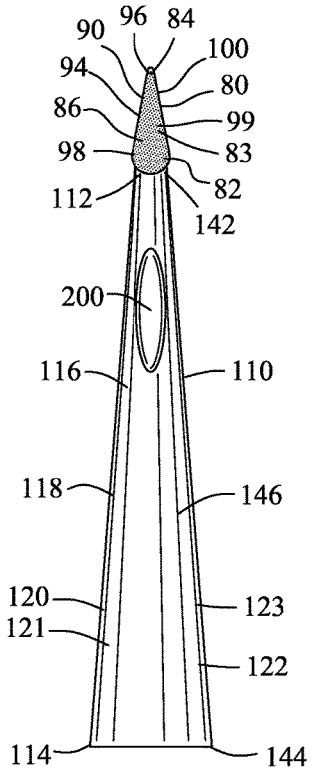
FIG. 21 is a front view of FIG. 17.
Figure 22:
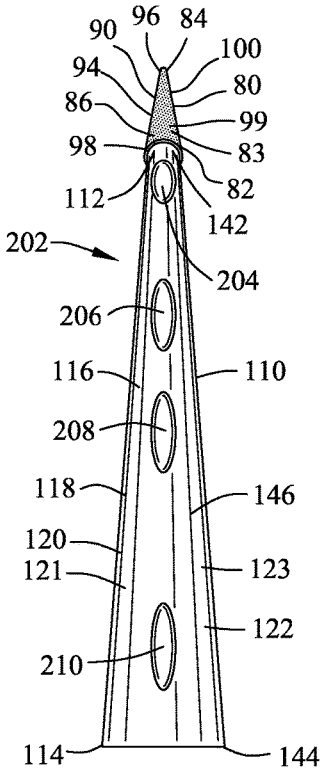
FIG. 22 is a rear view of FIG. 17.
Figure 23:
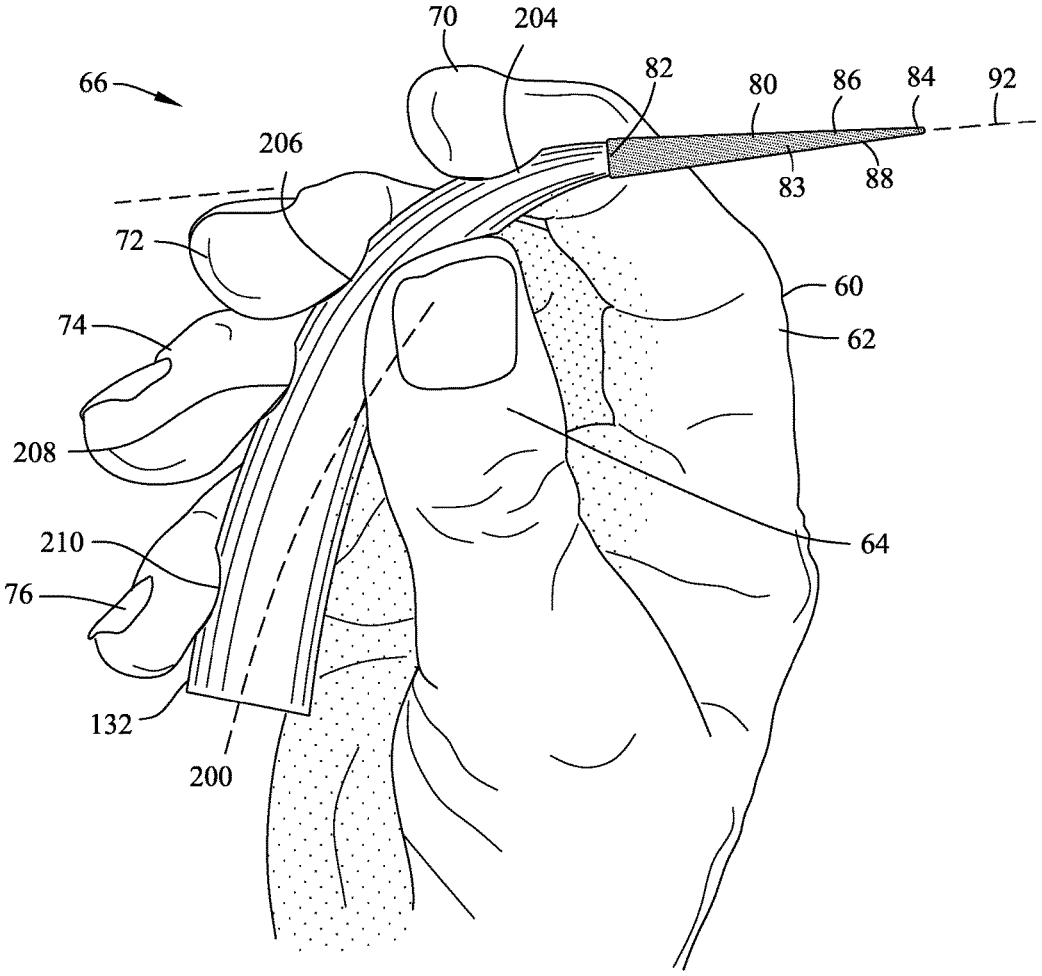
FIG. 23 is a view similar to FIG. 20 illustrating the hand grasping a handle of the cutlery sharpener.

As best shown in FIGS. 17-23, 30-38, 41 and 43, the handle 110 may further include an inner concave recess 200 and a plurality of outer concave recess 202. More specifically, the plurality of outer concave recess 202 may include an index recess 204, middle recess 206, ring recess 208 and little recess 210. As shown in FIGS. 20 and 23, the inner concave recess 200 facilitates the positioning of the thumb 64 of the hand 60 relative on to the handle 110. Furthermore, the index recess 204, middle recess 206, ring recess 208 and the little recess 210 facilitate the positioning of the index finger 70, middle finger 72, ring finger 74 and little finger 76 respectively relative on to the handle 110. The positioning of the inner concave recess 200 and a plurality of outer concave recess 202 relative to the handle 110 provide the thumb 64 and the plurality of fingers 66 of the hand 60 with a well-balanced and controlled gripping of the handle 110 for facilitating a well-balanced and, controlled engagement between the blade 30 and the sharpening shaft 80.

As shown in FIGS. 7-10 and 23-29 the cutlery sharpener 10 assists the user 62 in conditioning and/or sharpening the blade 30 by providing an improved gripping orientation between the thumb 64, plurality of fingers 66 and the handle 110 relative to both the sharpening shaft 80 and the blade 30. In addition, the cutlery sharpener 10 improves the safety during the conditioning and/or sharpening the blade 30 by providing a non-linear orientation between the sharpening shaft 80 and the handle 110 and a non-linear orientation between the thumb 64 and plurality of fingers 66 relative to the blade 30.

A further benefit of the cutlery sharpener 10 is contributable to the non-line of symmetry 130. The non-line of symmetry 130 maintains the thumb 64 and the plurality of fingers 66 of the hand 60 in a safe orientation and safe distance from the cutlery edge 20 during displacement of the handle 110 relative to the cutlery edge 20 and engagement between the cutlery edge 20 and the sharpening shaft 80. Furthermore, a second non-line of symmetry 136 extends through the proximal end 82 of the sharpening shaft 80 and distal end 114 of the handle 110. The second non-line of symmetry 136 maintains the thumb 64 and the plurality of fingers 66 of the hand 60 in a safe orientation and safe distance from the blade 30 during displacement of the handle 110 relative to the arrowhead 32 and engagement between the blade 30 and the sharpening shaft 80. The non-line of symmetry 130 and/or the second non-line of symmetry 136 create a non-linear displacement vector 230 of the cutlery sharpener 10 relative to the blade 30 during engagement between the sharpening shaft 80 and the blade 30.

Figure 24:
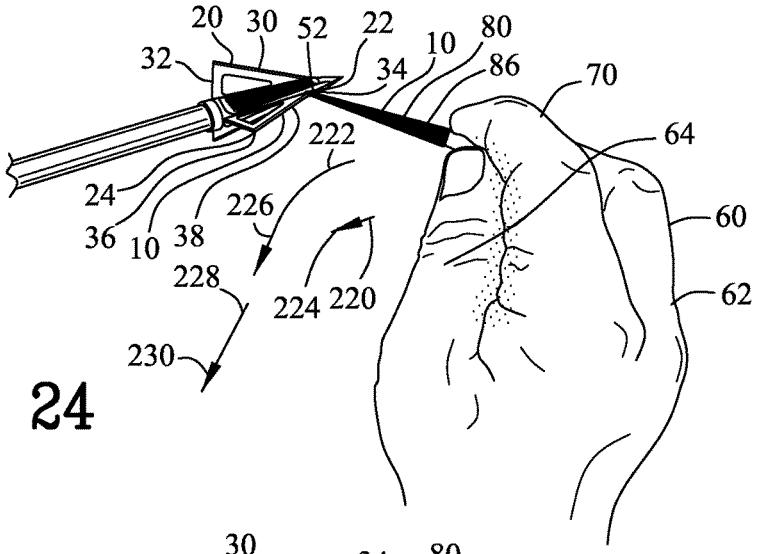
FIG. 24 is a view similar to FIG. 8 illustrating the distal end of the sharpening shaft having the first diameter engaging and sharpening an interior end of a blade on a first non mechanical fitted broadhead arrowhead by both a linear handle displacement and a rotation handle displacement for creating a compound sharpener displacement of the sharpening shaft relative to the blade.

FIGS. 8-10 and 24-29, illustrate the proper positioning and the method of displacement of the cutlery sharpener 10 relative to the blade 34 for conditioning and/or sharpening the blade 34. FIGS. 8, 24 and 27, illustrate an initial positioning and an initial method of displacement of the cutlery sharpener 10 relative to the blade 34 for conditioning and/or sharpening the blade 34. The initial position includes the distal end 84 of the sharpening shaft 80 having the first diameter 96 engaging and sharpening the interior end 34 of the blade 30. The first diameter 96 permits the distal end 84 of the sharpening shaft 80 to engage the interior end 34 of the blade 30 that is almost immediately adjacent to the shaft 42. As such, a very critical portion of the blade 30 may be conditioned and/or sharpened.

The initial method of displacement includes a linear handle displacement 220 and a rotation handle displacement 222. The linear handle displacement 220 of the handle 110 relative to the cutlery edge 20 or blade 30 causes a linear sharpener displacement 224 of the sharpening shaft 80 relative to the cutlery edge 20 or blade 30. The rotation handle displacement 222 of the handle 110 relative to the cutlery edge 20 or blade 30 causes a rotation sharpener displacement 226 of the sharpening shaft 80 relative to the cutlery edge 20 or blade 30. The linear sharpener displacement 224 and the rotation sharpener displacement 226 define a compound sharpener displacement 228 of the sharpening shaft 80 relative to the cutlery edge 20 or blade 30 for reducing the linear handle displacement 220 required for the sharpening shaft 80 to traverse against the cutlery edge 20 or blade 30. The non-line of symmetry 130 and/or the second non-line of symmetry 136 facilitate the compound sharpener displacement 228 for maintaining the thumb 64 and the plurality of fingers 66 of the hand 60 in a safe orientation and safe distance from the cutlery edge 20 or blade 30 and preventing contact between the hand 60 of the user 62 and the cutlery edge 20 or blade 30.

Figure 25:
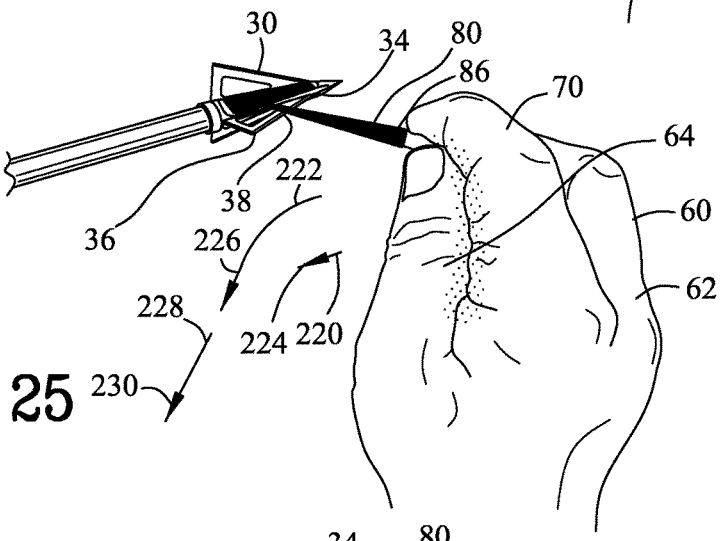
FIG. 25 is a view similar to FIG. 24 illustrating the intermediate portion of the sharpening shaft having the fifth diameter engaging and sharpening a midway portion of the blade by both the linear handle displacement and the rotation handle displacement for creating the compound sharpener displacement of the sharpening shaft relative to the blade.

FIGS. 9, 25 and 29, illustrate an intermediate positioning and an intermediate method of displacement of the cutlery sharpener 10 relative to the blade 34 for conditioning and/or sharpening the blade 34. The intermediate position includes the intermediate portion 83 of the sharpening shaft 80 having the fifth diameter 99 engaging and sharpening the midway portion 38 of the blade 30. The fifth diameter 99 permits a greater surface area of the sharpening shaft 80 to engage with the midway portion 38 of the blade 30. As such, the blade 30 is more efficiently conditioned and/or sharpened.

The intermediate method of displacement includes the linear handle displacement 220 and the rotation handle displacement 222. The linear handle displacement 220 of the handle 110 relative to the cutlery edge 20 or blade 30 causes the linear sharpener displacement 224 of the sharpening shaft 80 relative to the cutlery edge 20 or blade 30. The rotation handle displacement 222 of the handle 110 relative to the cutlery edge 20 or blade 30 causes the rotation sharpener displacement 226 of the sharpening shaft 80 relative to the cutlery edge 20 or blade 30. The linear sharpener displacement 224 and the rotation sharpener displacement 226 define the compound sharpener displacement 228 of the sharpening shaft 80 relative to the cutlery edge 20 or blade 30 for reducing the linear handle displacement 220 required for the sharpening shaft 80 to traverse against the cutlery edge 20 or blade 30. The non-line of symmetry 130 and/or the second non-line of symmetry 136 facilitate the compound sharpener displacement 228 for maintaining the thumb 64 and the plurality of fingers 66 of the hand 60 in a safe orientation and safe distance from the cutlery edge 20 or blade 30 and preventing contact between the hand 60 of the user 62 and the cutlery edge 20 or blade 30.

Figure 26:
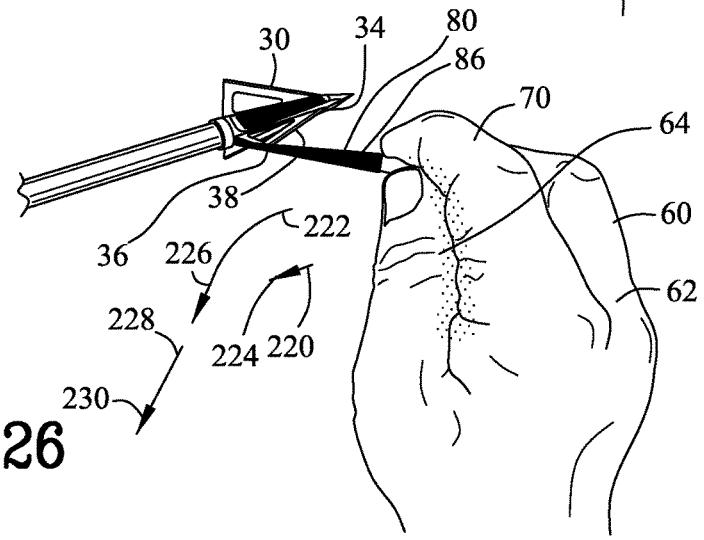
FIG. 26 is a view similar to FIG. 25 illustrating the proximal end of the sharpening shaft having the second diameter engaging and sharpening the exterior end of the blade by both the linear handle displacement and the rotation handle displacement for creating the compound sharpener displacement of the sharpening shaft relative to the blade.

FIGS. 10, 26 and 29 illustrate the final positioning and final method of displacement of the cutlery sharpener 10 relative to the blade 34 for conditioning and/or sharpening the blade 34. The final position includes proximal end 82 of the sharpening shaft 80 having the second diameter 98 engaging and sharpening the exterior end 36 of the blade 30. The second diameter 98 permits a greater surface area of the sharpening shaft 80 to engage with the exterior end 36 of the blade 30. As such, the blade 30 is more efficiently conditioned and/or sharpened.

The final method of displacement includes the linear handle displacement 220 and the rotation handle displacement 222. The linear handle displacement 220 of the handle 110 relative to the cutlery edge 20 or blade 30 causes the linear sharpener displacement 224 of the sharpening shaft 80 relative to the cutlery edge 20 or blade 30. The rotation handle displacement 222 of the handle 110 relative to the cutlery edge 20 or blade 30 causes the rotation sharpener displacement 226 of the sharpening shaft 80 relative to the cutlery edge 20 or blade 30. The linear sharpener displacement 224 and the rotation sharpener displacement 226 define the compound sharpener displacement 228 of the sharpening shaft 80 relative to the cutlery edge 20 or blade 30 for reducing the linear handle displacement 220 required for the sharpening shaft 80 to traverse against the cutlery edge 20 or blade 30. The non-line of symmetry 130 and/or the second non-line of symmetry 136 facilitate the compound sharpener displacement 228 for maintaining the thumb 64 and the plurality of fingers 66 of the hand 60 in a safe orientation and safe distance from the cutlery edge 20 or blade 30 and preventing contact between the hand 60 of the user 62 and the cutlery edge 20 or blade 30.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A cutlery sharpener for conditioning a cutlery edge, comprising:

a sharpener shaft extending longitudinally between opposing proximal and distal ends thereof about a reference line of symmetry, the sharpener shaft having a sharpening surface formed thereon between the distal end and a portion of the sharpener shaft adjacent the proximal end;

a handle having a distal handle end and a proximal handle end, the proximal handle end being aligned and pivotally joined with the proximal end of the sharpener shaft, the sharpener shaft being displaceable between a use position and a storage position, the handle having an arcuate contour extending between the distal and proximal handle ends, the handle having a reference line of non-symmetry extending linearly and external to the handle through a majority of a length of the handle between a central portion of the proximal handle end and a central portion of the distal handle end and intersecting the reference line of symmetry at the proximal handle end when the sharpener shaft is in the use position, the handle having a grasping portion thereof configured to be grasped by a user's hand, the grasping portion being angularly offset with respect to the reference line of symmetry at the proximal handle end when the sharpener shaft is in the use position, the handle having a cavity formed in a side thereof adjacent the distal handle end and into which the distal end of the sharpener shaft is received when in the storage position, in the storage position a longitudinal extent of the sharpener shaft that is defined by a majority of a length of the sharpener shaft between the proximal and distal ends thereof being spaced from and external to the side of the handle.

2. The cutlery sharpener as recited in claim 1, where the reference line of non-symmetry intersects the reference line of symmetry at an angle greater than ninety degrees and less than one hundred and eighty degrees.

3. The cutlery sharpener as recited in claim 1, where the arcuate contour of the handle is a tapering arcuate contour extending continuously from the distal handle end of a first dimension to the proximal handle end of a second dimension, the first dimension being greater than the second dimension.

4. The cutlery sharpener as recited in claim 1, where the pivotal coupling of the sharpener shaft to the proximal handle end includes a pivot mechanism, the pivot mechanism including:

a couple affixed coupled to the sharpener shaft and having a pivot plate extending from the proximal end of the sharpener shaft, the pivot plate being pivotally coupled to the handle within a pivot cavity formed in the proximal handle end, the pivot plate having a locking notch formed therein; and a longitudinally extended leaf spring having a first end affixed to the handle and a displaceable second end disposed in spring biased contact with the pivot plate, the displaceable second end engaging the locking notch when the sharpener shaft is in the use position to secure the sharpener shaft thereat, the sharpener shaft being rotatable to the storage position subsequent to a user laterally displacing the displaceable second end of the leaf spring from the engagement with the locking notch against a spring bias force of the leaf spring.

5. A cutlery sharpener for conditioning blades of a broadhead arrow tip having a plurality of radially extending blades angularly spaced one from another, the cutlery sharpener comprising:

a sharpener shaft extending longitudinally between opposing proximal and distal ends thereof about a reference line of symmetry, the sharpener shaft having a sharpening surface formed thereon between the distal end and a portion of the sharpener shaft adjacent the proximal end;

a handle having a distal handle end and a proximal handle end, the proximal handle end being aligned and pivotally joined with the proximal end of the sharpener shaft, the sharpener shaft being displaceable between a use position and a storage position, the handle having an arcuate contour extending between the distal and proximal handle ends, the handle having a reference line of non-symmetry extending linearly and partially external to the handle between a central portion of the proximal handle end and a central portion of the distal handle end and intersecting the reference line of symmetry at the proximal handle end when the sharpener shaft is in the use position, the handle having a cavity formed therein adjacent the distal handle end into which the distal end of the sharpener shaft is received when in the storage position, in the storage position a longitudinal extent of the sharpener shaft that is defined by a majority of a length of the sharpener shaft between the proximal and distal ends thereof being spaced from and external to the handle, the handle having a grasping portion thereof configured to be grasped by a user's hand angularly offset with respect to the reference line of symmetry at the proximal handle end when the sharpener shaft is in the use position, whereby while conditioning one of the plurality of radially extending blades of the broadhead arrow tip, a user's hand grasping the grasping portion of the handle is angularly spaced from all of the plurality of radially extending blades.

6. The cutlery sharpener as recited in claim 5, where the grasping portion of the handle has a first side with at least a portion thereof intersecting the reference line of non-symmetry and an opposing second side spaced from the reference line of non-symmetry, the second side having a plurality of finger receiving concave recesses formed therein with a first of the plurality of finger receiving concave recesses being configured to receive a user's index finger therein and being spaced from the proximal handle end, a remaining portion of the plurality of finger receiving concave recesses being angularly spaced from the first finger receiving concave recess and one from another, each one of the remaining portion of the plurality of finger receiving concave recesses being configured to receive a corresponding one of other of a user's fingers therein, the first side having an thumb receiving concave recess spaced from the proximal handle end and configured to receive a user's thumb therein.

7. The cutlery sharpener as recited in claim 6, where the remaining portion of the plurality of finger receiving concave recesses includes a second of the plurality of finger receiving concave recesses configured to receive a user's middle finger therein, a third of the plurality of finger receiving concave recesses configured to receive a user's ring finger therein and a fourth of the plurality of finger receiving concave recesses configured to receive a user's index finger therein.

8. The cutlery sharpener as recited in claim 6, where the thumb receiving concave recess is spaced from the proximal handle end a greater distance than the first of the plurality of outer side concave recesses.

9. The cutlery sharpener as recited in claim 5, where the arcuate contour of the handle is a continuous tapering arcuate contour, the distal handle end being of a first dimension and the proximal handle end being of a second dimension, the first dimension being greater than the second dimension.

10. The cutlery sharpener as recited in claim 5, where the pivotal coupling of the sharpener shaft to the proximal handle end includes a pivot mechanism, the pivot mechanism including:

a couple affixed to the sharpener shaft and having a pivot plate extending from the proximal end of the sharpener shaft, the pivot plate being pivotally coupled to the handle within a pivot cavity formed in the proximal handle end thereof, the pivot plate having a locking notch formed therein; and a longitudinally extended leaf spring having a first end affixed to the handle and a displaceable second end disposed in spring biased contact with the pivot plate, the displaceable second end engaging the locking notch when the sharpener shaft is in the use position to secure the sharpener shaft thereat, the sharpener shaft being rotatable to the storage position subsequent to a user laterally displacing the displaceable second end of the leaf spring from the engagement with the locking notch against a spring bias force of the leaf spring.

* * * * *